United States Patent [19]

Miyanaka et al.

[11] 4,370,126

[45] Jan. 25, 1983

[54] COMBUSTION CONTROL APPARATUS

[75] Inventors: Motoshi Miyanaka; Kenzi Toudo; Yoshinori Kudo, all of Yanai; Sumio Nakagawa, Matudo, all of Japan

[73] Assignee: Hitaci, Ltd., Tokyo, Japan

[21] Appl. No.: 197,775

[22] PCT Filed: Aug. 31, 1979

[86] PCT No.: PCT/JP79/00231

§ 371 Date: May 5, 1980

§ 102(e) Date: May 5, 1980

[87] PCT Pub. No.: WO80/00609

PCT Pub. Date: Apr. 3, 1980

[30] Foreign Application Priority Data

Sep. 11, 1978 [JP] Japan ..... 53-110773

[51] Int. Cl.[3] ..... F23N 5/00

[52] U.S. Cl. ..... 431/73; 431/31

[58] Field of Search ..... 431/29–31, 431/45, 67, 69, 71, 73, 74, 78

[56] References Cited

U.S. PATENT DOCUMENTS 4,145,179 3/1979 Tanaka et al. ..... 431/29
4,230,444 10/1980 Matthews ..... 431/26
4,249,884 2/1981 Cade ..... 431/31

FOREIGN PATENT DOCUMENTS 50-60622 7/1975 Japan .

*Primary Examiner*—Samuel Scott
*Assistant Examiner*—Lee E. Barrett
*Attorney, Agent, or Firm*—Antonelli, Terry & Wands

[57] ABSTRACT

This invention relates to a control circuit which controls combustion in a burner acting as a heat source of a hot-water boiler or a hot-air heater. More particularly, the present invention relates to a control circuit having a sequence which includes post-discharge such that electric discharge for ignition is still continued for a predetermined period of time, even after attainment of ignition. In a combustion control apparatus, when ignition is not attained within a predetermined safty period, the igniting operation is stopped by a safty timer for timing this safety period, thereby ensuring the safety. It is necessary to reliably discontinue the igniting operatin even when this safety timer is disabled. The present invention attains this object and ensures the safety with a reduced number of timers. That is, a timer for timing the post-discharge period is provided independently of the safety timer, these two timers starting their timing operations at the same time, so that the fuel valve can be cut off by an output from the post-discharge timer too in the event of failure of ignition.

3 Claims, 3 Drawing Figures

COMBUSTION CONTROL APPARATUS

DESCRIPTION

TECHNICAL FIELD

This invention relates to a circuit in a combustion control apparatus which controls combustion in a burner acting as a heat source of a hot-water boiler or a hot-air heater. More particularly, the present invention relates to a control circuit having a sequence which includes post-discharge such that an electric discharge operation for ignition may still be continued even after attainment of ignition of fuel.

BACKGROUND ART

A combustion control apparatus must be constructed so as to ensure safety by stopping the supply of fuel when fuel ignition is not attained within a predetermined safety period of time after the igniting operation has been started. It must also be constructed so as to ensure safety when a safety timer acting to stop the supply of fuel is disabled.

A combustion control apparatus of this kind will be described with reference to FIGS. 1 and 2. In such an apparatus, pre-purge is effected prior to starting of combustion, in which a combustion air blower is driven to supply air for purging unburned gas remaining within a furnace. Description will be specifically directed to such an apparatus provided with this pre-purging function. Description will also be specifically directed to such an apparatus in which its operation sequence includes the step of post-discharge.

Referring to FIGS. 1 and 2, when the temperature of an object to be heated drops, a signal indicative of such a temperature drop is applied through an input terminal 1 to a control circuit 2. This signal constitutes an operation starting signal. In response to the application of this signal, a blower drive signal is delivered through a terminal 3, and a blower starts its operation to start pre-purge. At the same time, in response to the operation starting signal, a timer circuit 4 starts its timing operation by dividing the frequency of clock pulses applied through a terminal 5. Upon lapse of a predetermined period of time (which will be referred to hereinafter as a pre-purge period), a pre-purge termination signal is delivered from the timer circuit 4, and in response to this signal, an igniter drive signal and a fuel valve drive signal are delivered through terminals 6 and 7 to drive an igniter and a fuel valve respectively, thereby commencing the igniting operation. The igniter effects electric discharge. When ignition is attained within a predetermined period of time (which will be referred to hereinafter as a safety period), a flame signal is applied to the control circuit through a terminal 8 to continue the operation, and the electric discharge is still continued for an additional predetermined period of time (which will be referred to hereinafter as a post-discharge period). Thereafter, steady combustion is maintained.

If ignition is not sensed within the safety period, a judgement is made so that there happens a trouble, and an ignition failure signal is generated in response to a safety period termination signal produced from the timer circuit 4, and a safety unit drive signal is delivered through a terminal 9 so that a safety unit is operated to stop the blower, fuel valve and igniter, as shown by broken lines in FIG. 2, for ensuring the safety.

Thus, when ignition fails to take place, the safety period termination signal appearing from the timer circuit 4 acts to cut off the fuel valve. Therefore, if a trouble occurs in the timer timing the safety period, the safety period termination signal would not be delivered, and fuel would be continuously discharged in the event of ignition failure, resulting in a serious danger.

In the prior art practice, two timers each timing this safety period have been provided to deal with such a dangerous situation. Therefore, a timer for timing the pre-purge period, a timer for timing the post-discharge period and two timers for timing the safety period, that is, a total of four timers have been necessarily required heretofore.

DISCLOSURE OF THE INVENTION

It is an object of the present invention to ensure safety with a reduced number of timers. According to the present invention, a safety timer for timing the safety period and a post-discharge timer for timing the post-discharge period are provided independently of each other, and the post-discharge timer starts its timing operation in concurrent relation with the starting of the timing operation of the safety timer to time the safety period and then the post-discharge period follows the termination of the safety period, so that an output from the post-discharge timer can also act to cut off the fuel valve in the event of ignition failure. According to the present invention, therefore, the fuel valve can be cut off upon termination of the post-discharge period even when the safety timer would not properly operate in the situation in which ignition fails to take place, and the post-discharge timer functions as a second safety timer for the safety timer, so that the safety can be ensured with a reduced number of timers.

BEST MODE FOR CARRYING OUT THE INVENTION

Figure 1:
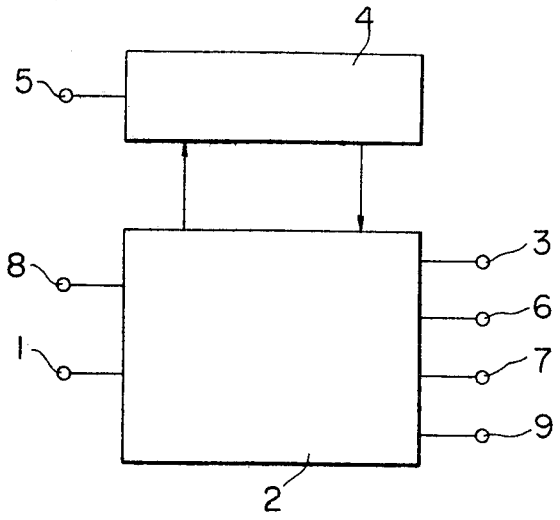
FIG. 1 is a block diagram of a combustion control apparatus.
Figure 2:
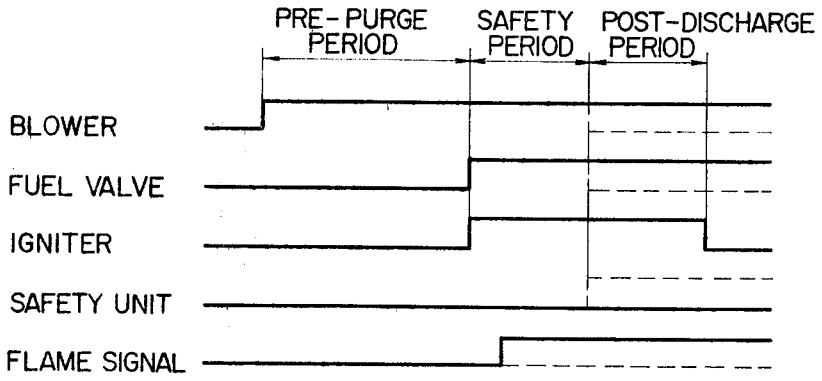
FIG. 2 is a diagram for explaining the operation of the individual units in the combustion control apparatus.
Figure 3:
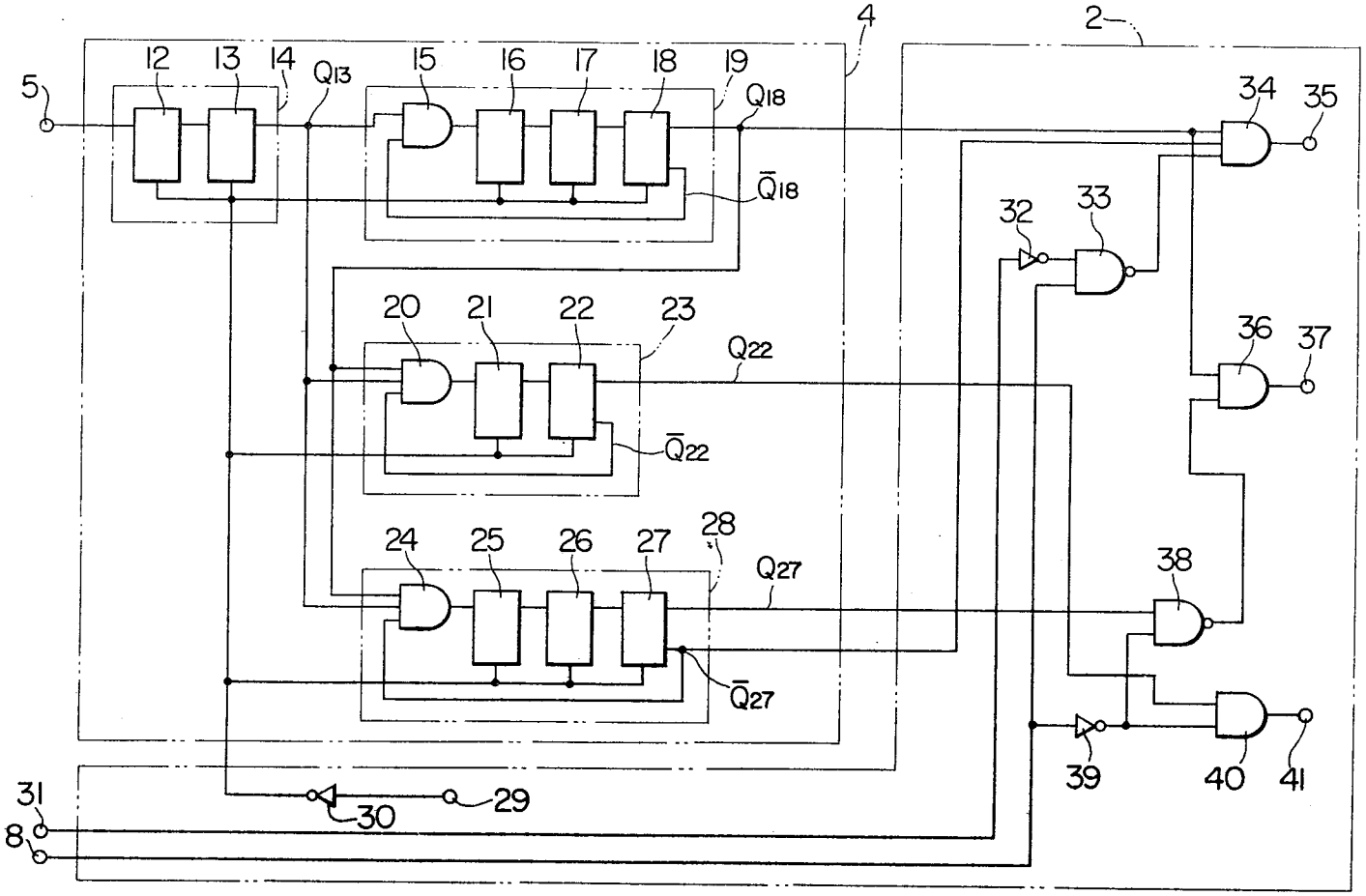
FIG. 3 is a circuit diagram of an embodiment of the combustion control apparatus according to the present invention.

The present invention will now be described with reference to an embodiment shown in FIG. 3. This embodiment comprises an integrated circuit having two sequences, one including post-discharge and the other including no such a post-discharge. Signals at various terminals in FIG. 3 are digital ones of "0" or "1".

Numerals 12 and 13 designate flip-flops constituting a reference timer 14. Numeral 15 designates an AND gate, and numerals 16, 17 and 18 designate flip-flops, which constitute a timer 19 (which will be referred to hereinafter as a pre-purge timer) for timing the pre-purge period. Numeral 20 designates an AND gate, and numerals 21 and 22 designate flip-flops, which constitute another timer 23 (which will be referred to hereinafter as a safety timer) for timing the safety period. Numeral 24 designates an AND gate, and numerals 25, 26 and 27 designate flip-flops, which constitute another timer 28 (which will be referred to hereinafter as a post-discharge timer) for timing the post-discharge period.

Numeral 29 designates a terminal at which a signal of "1" instructing the starting of operation appears in response to a signal indicative of a temperature drop of an object to be heated through the terminal 1. This terminal 29 is connected through an inverter 30 to the reset terminals of the individual timers 14, 19, 23 and 28.

Numeral 31 designates a terminal which selectively indicates the presence or absence of the post-discharge. A signal of "1" is applied to this terminal 31 in the event of "presence". Numeral 32 designates an inverter, 33 a NAND gate and 34 an AND gate. An output terminal 35 of the AND gate 34 constitutes an igniter drive terminal, which is connected to an output circuit having the terminal 6. Numeral 36 designates an AND gate which is connected to a fuel valve drive terminal 37. This terminal is connected to an output circuit having the terminal 7. Numeral 38 designates a NAND gate, 39 an inverter and 40 an AND gate. The output terminal of this AND gate 40 constitutes a safety unit drive terminal 41 which is connected to an output circuit having the terminal 9.

With such a construction, an explanation will be made of the case where the post-discharge is present. A signal of logic level "1" is applied to the terminal 31. When the signal at the operation starting signal terminal 29 is turned from "0" to "1" to instruct the starting of operation, the blower is driven by a separate circuit to start the pre-purge, and at the same time, the output of the inverter 30 becomes "0" and the reset inputs of the individual timers 14, 19, 23 and 28 are "0" to release these timers from their reset state. Consequently, the reference timer 14 starts its frequency dividing operation on the clock pulses 5, and the pre-purge period begins from this time. When an output $Q_{13}$ becomes "1", the output of the AND gate 15 becomes "1" since the output $\overline{Q}_{18}$ of the pre-purge timer 19 is "1", and the pre-purge timer 19 starts its frequency dividing operation.

Upon lapse of the pre-purge period, "1" is delivered at the output $Q_{18}$ of the pre-purge timer 19. This output provides an ignition starting signal. This signal $Q_{18}$ is applied to the AND gate 20 in the safety timer 23 and to the AND gate 24 in the post-discharge timer 28, and, since the output $\overline{Q}_{22}$ and the output $\overline{Q}_{27}$ of these timers 23 and 28 are "1", these timers 23 and 28 start their frequency dividing operation in response to the output $Q_{13}$ of the reference timer 14. The safety period begins from this time. The level "0" at the output $\overline{Q}_{18}$ of the pre-purge timer 19 maintains the level "1" at the output $Q_{18}$.

The output of the inverter 32 is "0" at this time, and hence the output of the NAND gate 33 is "1". Consequently, the output of the AND gate 34 becomes "1" and thus the level at the igniter drive terminal 35 is "1" to drive the igniter, and the electric discharge is started in the igniter. The output $Q_{27}$ of the post-discharge timer 28 is "0" at this time, and hence the output of the NAND gate 38 is "1". Since the inputs to the AND gate 36 are both "1", its output becomes "1" and thus the level at the fuel valve drive terminal 37 is "1" to open the fuel valve. As a result, the igniting operation starts.

When ignition is attained within the safety period and a flame signal of "1" is applied to the terminal 8, the output of the inverter 39 is "0", and the output of the AND gate 40 is "0" so that the level at the safety unit drive terminal 41 remains "0". Therefore, the safety unit would not be operated even if an output of "1" is delivered from the output $Q_{22}$ of the safety timer 23 upon lapse of the safety period. The electric discharge in the igniter continues, since the output of the NAND gate 33 remains "1", and hence the output of the AND gate 34 is maintained at "1". The output $\overline{Q}_{22}$ of the safety timer 23 is "0", whereby the safety timer 23 is held in that state.

As soon as the post-discharge period terminates with further lapse of time, the output $\overline{Q}_{27}$ of the post-discharge timer 28 becomes "0" to turn the output of the AND gate 34 to "0", and the operation of the igniter is stopped. Although the output $Q_{27}$ becomes "1", the fuel valve is maintained in its open position to permit a shift to the state of steady combustion, since ignition has already been attained with the output of the NAND gate 38 being "1".

When the ignition is not attained within the safety period, the level at the terminal 8 is "0". Thus, the output of the inverter 39 is "1" and, due to the output $Q_{22}$ of "1" of the safety timer 23, the output of the AND gate 40 becomes "1" and hence the level at the safety unit drive terminal 41 is "1". As a result, the safety unit is operated to cut off power supply to the blower, igniter and fuel valve so as to stop the operation and, at the same time, to display an alarm condition.

Further, when the ignition is not attained and upon lapse of the post-discharge period, since the output $Q_{27}$ becomes "1", the inputs to the NAND gate 38 are both "1", with the result that the output of the NAND gate 38 becomes "0" and the output of the AND gate 36 becomes "0". Thus, the level of the fuel valve drive terminal 37 is "0" to instruct cutting-off of the fuel valve. The output $\overline{Q}_{27}$ becomes "0" to turn the output of the AND gate 34 into "0" thereby instructing stoppage of the igniter. This state is held by the AND gate 24.

That is, in the event of failure of attainment of ignition, the fuel valve is cut off in a duplicate manner through the safety unit by the safety timer 23 and through the terminal 37 by the post-discharge timer 28.

Therefore, even when a trouble is caused in any of the safety timer 23, the AND gate 40, the output circuit and the safety unit, and the alarm unit may not be operated in spite of failure of attainment of ignition, the output of the post-discharge timer 28 can close the fuel valve, thereby obviating the danger. That is, the post-discharge timer 28 functions as a second safety timer for the safety timer 23.

Although the operation of the blower cannot be stopped in this case, the operation of the blower is allowable since it is not dangerous in any way. Further, although the alarm display unit such as an alarm lamp is also not operated, the alarming condition can be recognized only by the continuous operation of the blower.

The above description has been directed to the case of failure of attainment of ignition within the safety period, but similar procedures are applicable to the case where flame extinction occurs after the safety period. Upon lapse of the safety period, due to the output $\overline{Q}_{22}$ of "0", the output $Q_{22}$ is maintained at "1". In the event of flame extinction within the post-discharge period, since the output $Q_{22}$ of the safety timer is "1", the safety unit is operated as soon as the flame extinction occurs. And, upon lapse of the post-discharge period, the output circuit connected to the solenoid-operated valve is cut off. In the event of flame extinction after the post-discharge period, the output circuit connected to the solenoid-operated valve is cut off simultaneously with the start of operation of the safety unit, since the output $Q_{22}$ and the output $Q_{27}$ are already "1".

Description will next be made of the case where the sequence does not include the post-discharge. In this case, the level at the terminal 31 is "0". Therefore, the output from the NAND gate 33 is determined by the flame signal at the terminal 8. That is, when ignition is attained and "1" appears at the terminal 8, the output of the NAND gate 33 becomes "0" to stop the electric discharge in the igniter. The other operations are similar to those of the case where the sequence includes the post-discharge. Thus, the post-discharge timer 28 functions only as a second safety timer for the safety timer 23. When the ignition fails to be attained and the safety timer 23 is faulty, fuel will be continuously discharged until the fuel valve is cut off by the post-discharge timer, after the termination of the safety period. However, any problem will not be caused if such a period of time is such that any danger will not be given rise to within that period. Generally, the post-discharge period in the burner of this kind is short, and therefore, the post-discharge timer 28 can be utilized, as it is, as the second safety timer.

In the aforementioned embodiment, the output of the NAND gate 38 is used to control the fuel valve only, but it may be applied to the AND gate 40. In such a case, the operation can be stopped by using the safety unit, provided that the AND gate 40 is normal.

Although the aforementioned embodiment has been described with reference to the case of including the pre-purge, it can also be applied to the case where such a pre-purge is not included. Further, although the description has been made with reference to the case of involving two sequences, it can also be applied to the case where a single sequence including post-discharge is involved.

In the aforementioned embodiment, the presence or absence of a flame is checked after the safety period has elapsed. However, the output of the inverter 39 may be connected to the input of the AND gate 20 so that the output $Q_{22}$ may be delivered only when the flame signal is not applied.

In the aforementioned embodiment, it is described that the safety unit is operated in response to an occasional flame extinction. However, the safety unit may be constructed so that it is not operated, if a re-ignition operation or, for example, the start of pre-purge is restored in response to an occasional flame extinction.

We claim:

1. A combustion control apparatus, including fuel supply drive means and igniter drive means for allowing a fuel supply and an ignition operation to be effected at least for a first predetermined period of time, said fuel supply being further continued, and said ignition operation being effected sequentially until termination of a second predetermined period of time subsequent to the first predetermined period of time, when ignition is attained within the first predetermined period of time, while said fuel supply and ignition operation being discontinued at termination of the first predetermined period of time, when ignition is not attained within the first predetermined period of time, said apparatus also including a first timer supplied with clock pulses for timing the first predetermined period of time and producing at the termination of the first predetermined period of time a signal indicating said discontinuation of the fuel supply and ignition operation when ignition is not attained within the first predetermined period of time, and a second timer supplied with clock pulses for timing the second predetermined period of time independently from the timing operation of said first timer, wherein said apparatus further comprises a first circuit generating a signal for cutting off a fuel valve in response to an output delivered from said second timer at the termination of the second predetermined period of time and a flame-absence signal applied through a flame signal input terminal and a second circuit for maintaining generation of said fuel valve cutting-off signal.

2. A combustion control apparatus, including fuel supply drive means for allowing a fuel supply to be effected at least for a first predetermined period of time, igniter drive means for allowing an ignition operation to be effected at most for the first predetermined period of time and a second predetermined period of time subsequent to the first predetermined period of time, a first timer supplied with clock pulses for timing the first predetermined period of time and producing at termination of the first predetermined period of time a signal indicating discontinuation of the fuel supply and ignition operation when ignition is not attained within the first predetermined period of time, a second timer supplied with clock pulses for timing the second predetermined period of time independently from the timing operation of said first timer, and selecting means for selecting, when ignition is attained within the first predetermined period of time, one of continuation of the ignition operation until termination of the second predetermined period of time after the termination of the first predetermined period of time and discontinuation of the ignition operation within the first predetermined period of time, wherein said apparatus further comprises a first circuit generating a signal for cutting off a fuel valve in response to an output delivered from said second timer at the termination of the second predetermined period of time and a flame-absence signal applied through a flame signal input terminal and a second circuit for maintaining generation of said fuel valve cutting-off signal, and said selecting means is connected to said igniter drive means without affecting said second timer and first circuit so that said second timer delivers said output to said first circuit irrespectively of the selection of either said continuation or said discontinuation.

3. A combustion control apparatus according to claims 1 or 2, wherein said second circuit includes an output connected to said second timer, an input to which the clock pulses to be supplied to the second timer are applied, and another input supplied with a signal delivered from the second timer at the termination of the second predetermined period of time, thereby preventing supply of the clock pulses to said second timer after the termination of the second predetermined period of time.

* * * * *